US009431764B2

(12) United States Patent
Ho

(10) Patent No.: US 9,431,764 B2
(45) Date of Patent: Aug. 30, 2016

(54) THIN CARD PLUG

(71) Applicant: Molex, LLC, Lisle, IL (US)

(72) Inventor: Yi-Tse Ho, Taipei (TW)

(73) Assignee: Molex, LLC, Lisle, IL (US)

( * ) Notice: Subject to any disclaimer, the term of this patent is extended or adjusted under 35 U.S.C. 154(b) by 247 days.

(21) Appl. No.: 14/016,656

(22) Filed: Sep. 3, 2013

(65) Prior Publication Data

US 2014/0170906 A1 Jun. 19, 2014

(30) Foreign Application Priority Data

Aug. 31, 2012 (TW) ..... 101216848 U

(51) Int. Cl.

| | |
|---|---|
| ***H01R 13/64*** | (2006.01) |
| ***H01R 13/645*** | (2006.01) |
| ***H01R 13/6581*** | (2011.01) |
| ***H01R 27/00*** | (2006.01) |
| ***H01R 13/44*** | (2006.01) |

(52) U.S. Cl.

CPC ..... *H01R 13/6456* (2013.01); *H01R 13/44* (2013.01); *H01R 13/6581* (2013.01); *H01R 27/00* (2013.01)

(58) Field of Classification Search

CPC ..... H01R 27/00; H01R 13/6456

See application file for complete search history.

(56) References Cited

U.S. PATENT DOCUMENTS 6,000,954 A * 12/1999 Medina ..... H01R 13/42 439/607.28
6,685,508 B2 * 2/2004 Zhu ..... H01R 24/62 439/607.01
6,896,527 B1 * 5/2005 Peng ..... H01R 13/6585 439/108
7,335,036 B1 * 2/2008 Lin ..... G06K 7/0021 439/131
7,959,478 B2 6/2011 Chiu et al.
2008/0045084 A1 * 2/2008 Chang ..... H01R 13/6594 439/607.01
2008/0299831 A1 * 12/2008 Kim ..... H01R 13/6278 439/638
2009/0053932 A1 2/2009 Zhou et al.
2009/0130906 A1 * 5/2009 Tsao ..... H01R 13/58 439/626
2009/0215284 A1 * 8/2009 Zhao ..... H01R 13/64 439/55
2011/0269341 A1 * 11/2011 He ..... H01R 24/60 439/607.01
2012/0196483 A1 * 8/2012 Kuster ..... H01R 27/00 439/626
2012/0231643 A1 * 9/2012 Kim ..... H01R 27/00 439/170
2014/0113487 A1 * 4/2014 Chen ..... H01R 24/62 439/607.01
2014/0170906 A1 * 6/2014 Ho ..... H01R 13/44 439/676

* cited by examiner

*Primary Examiner* — James Harvey
(74) *Attorney, Agent, or Firm* — Stephen L. Sheldon

(57) ABSTRACT

A plug connector comprises a housing, a plurality of first terminals, a plurality of second terminals and a pair of side plates. The housing has a base and a tongue extending forwardly from the base. The base has a mating limit portion connecting the tongue. Each first terminal has a resilient contact portion extending out of a plate surface of the tongue. Each second terminal has a flat plate contact portion positioned along and exposed from the plate surface and positioned in front of the resilient contact portions. The pair of side plates are provided, one along each side of the tongue, and the two side plates extend along a first, for-aft, direction above the plate surface so as to help protect the resilient contact portions.

18 Claims, 20 Drawing Sheets

THIN CARD PLUG

RELATED APPLICATIONS

This application claims priority to Taiwanese Application No. 1012116848, filed Aug. 31, 2012, which is incorporated herein by reference in its entirety.

TECHNICAL FIELD

The application relates to an electrical connector, particularly to a low profile plug connector, and an electrical connection device and an electronic device which comprise the plug connector.

BACKGROUND ART

Portable electronic products push toward thinness and lightness has become a mainstream trend, and electrical connectors used in the portable electronic products are required to help enable the trend. For example, US Patent Publication No. US 2009/0053932 (corresponding to Chinese Patent application No. CN 200710076574.7) discloses a USB plug connector with low profile, referring to FIG. 1, the plug connector has a plate-shaped housing 91 and a plurality of conductive terminals 92 provided to a top face 911 of the housing 91. Each conductive terminal 92 has a convex cross section and is protruded out from the top face 911 of the housing 91, after the plug connector is inserted into a standard USB receptacle, the conductive terminal 92 elastically deforms due to pressing from the corresponding conductive terminal of the standard USB receptacle. Both sides of the top face 911 of the housing 91 are respectively provided with side ribs 912 protruding along an extending direction of the conductive terminal 92 to prevent incorrect insertion in use.

The plug connector omits a cage generally used in a plug so as to reduce the thickness. However, the above-described patent does not disclose how to make the terminals of the plug connector reach the correct contact operative position with the receptacle terminal. And the plug connector is only configured to transmitting a signal conforming to USB2.0 specification while a plug connector with the USB3.0 specification would require an arrangement of two rows of terminals, one row of resilient terminals would be relatively protruded, and such a configuration would be easily damaged without the protection provided by a cage. Therefore, for the plug connector with the USB3.0 specification requiring for the resilient terminal, it is an significant issue to provide a plug connector that is thin and light and still protects the resilient terminal and that can ensure the desired contact operative position with the receptacle terminal.

SUMMARY OF THE INVENTION

According to an embodiment, a plug connector of the present application comprises a housing, a plurality of first terminals, a plurality of second terminals and a pair of side plates. The housing has a base and a tongue extending forwardly from the base along a front-rear direction. The base has a mating limit portion connecting the tongue and higher than a plate surface of the tongue. The plurality of first terminals are mounted to the housing, and the each first terminal has a resilient contact portion exposed out from the plate surface of the tongue. The resilient contact portions are arranged in one row. The plurality of second terminals are mounted to the housing, and the each second terminal has a flat plate contact portion exposed out from the plate surface of the tongue. The flat plate contact portions are arranged in one row and positioned in front of the resilient contact portions. Each one of the side plates are positioned along a respective side of the tongue. The two side plates extend along the first, for-aft, direction and heights of the two side plates that is higher than the plate surface extends along and is higher than a height of the resilient contact portions which are exposed out from the plate surface, which allows the resilient contact portions to be position between the two side plates.

According to another embodiment, the plug connector further comprises a metal plate mounted to one side of the housing opposite to the plate surface. The two side plates integrally extend from both sides of the metal plate respectively, and are positioned at both sides of the tongue and the mating limit portion respectively. The retained portions of the support arms are formed respectively by integrally extending from the metal plate.

According to an embodiment, an electrical connection device comprises the plug connector as described above and a receptacle connector which can mate the plug connector to form electrical connection. The receptacle connector comprises a tongue plate, a cage and a plurality of flat plate terminals and a plurality of resilient terminals mounted to the tongue plate. The cage surrounds the tongue plate to define a mating space and an insert port. The flat plate terminals are arranged as one row and respectively correspond to the resilient contact portions of the first terminals and are closer to the insert port than the resilient terminals. The resilient terminals are arranged as one row and respectively correspond to the flat plate contact portions of the second terminals. When the plug connector and the receptacle connector are mated, the tongue is received in the mating space to mate the tongue plate and the mating limit portion abuts against an end face of the tongue plate facing the insert port, so as to allow the resilient contact portions of the first terminals to respectively contact the flat plate terminals and allow the flat plate contact portions of the second terminals to respectively contact the resilient terminals.

According to an embodiment, an electronic device of the present application comprises the plug connector as described above, a circuit board and an outer casing. The circuit board is connected to a rear side of the base, and the first tail portions and second tail portions are electrically connected to the circuit board. The outer casing surrounds and covers a rear end of the base, and extends rearwardly and covers the first tail portions, the second tail portions and the circuit board.

DETAILED DESCRIPTION OF THE PREFERRED EMBODIMENTS

Figure 1:
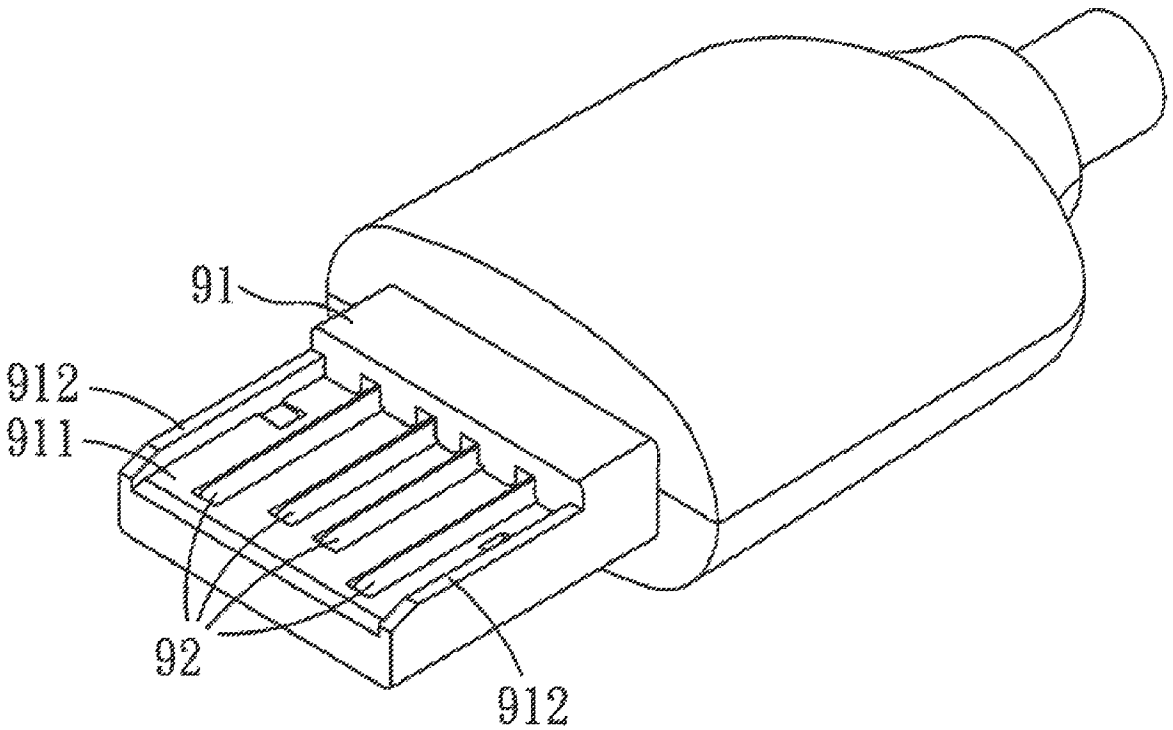
Fig. 1 (Prior Art)
FIG. 1 is a perspective view illustrating a thinned-type plug connector in the prior art.

The foregoing and other technical contents, features and effects of the embodiments will be apparent through the following detailed description for three embodiments in combination with the drawings. Before the embodiments are described in details, it should be noted that like elements are indicated by like reference numerals in the following description.

As can be appreciated, the application discloses a thin plug connector that can protect a resilient terminal and help ensure a correct contact operative position with a receptacle terminal. The disclosure provides a connector that can provide the following benefits. The plug connector is a thin, low profile plug that has the resilient contact portion and the flat plate contact portion. As the mating limit portion abuts against the end face of the tongue plate facing the insert port, insertion depth and position of the tongue of the plug connector inserted into receptacle connector can be limited, so as to ensure the resilient contact portion and the flat plate contact portion of the plug connector reach the correct contact operative position respectively with the flat plate terminal and the resilient terminal of the receptacle connector. And, both sides of the resilient contact portions can be protected from damaging due to inappropriate external force by the two side plates. Moreover, the metal plate can function as electromagnetic shielding protection.

Figure 2:
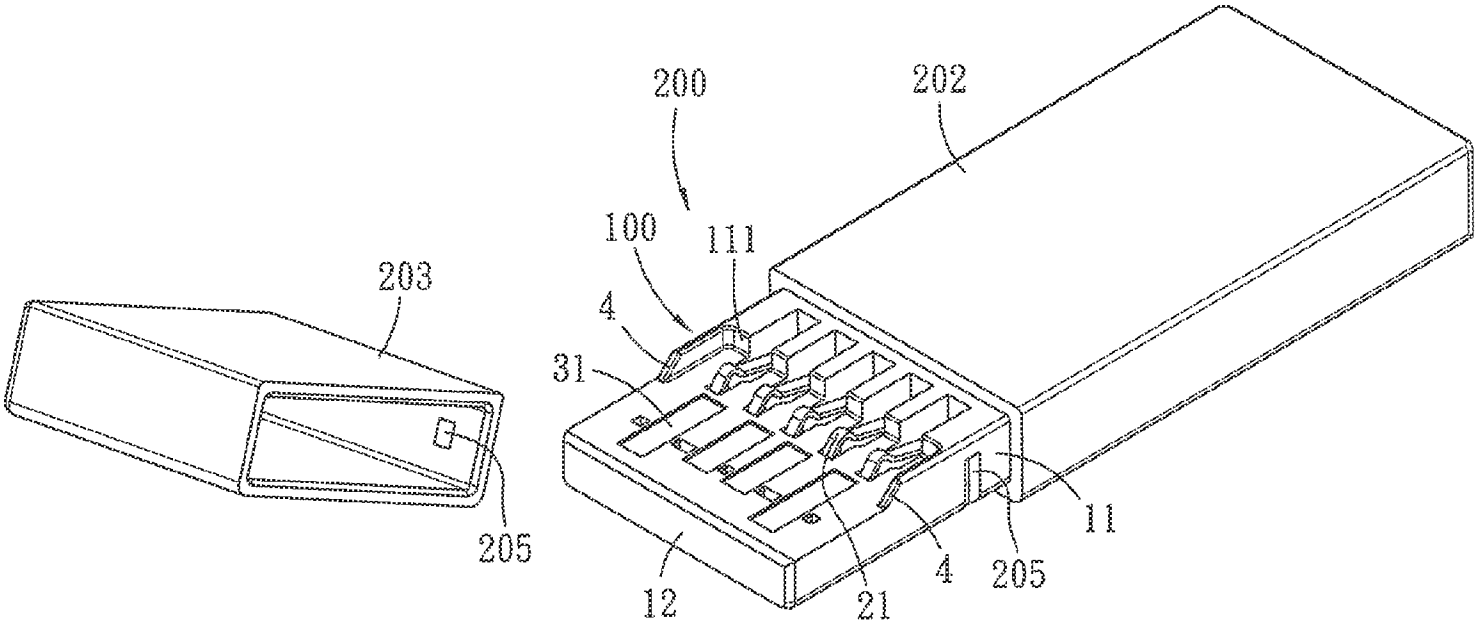
FIG. 2 is a perspective view illustrating a plug connector in a first embodiment of the application and an electronic device comprising the plug connector.
Figure 3:
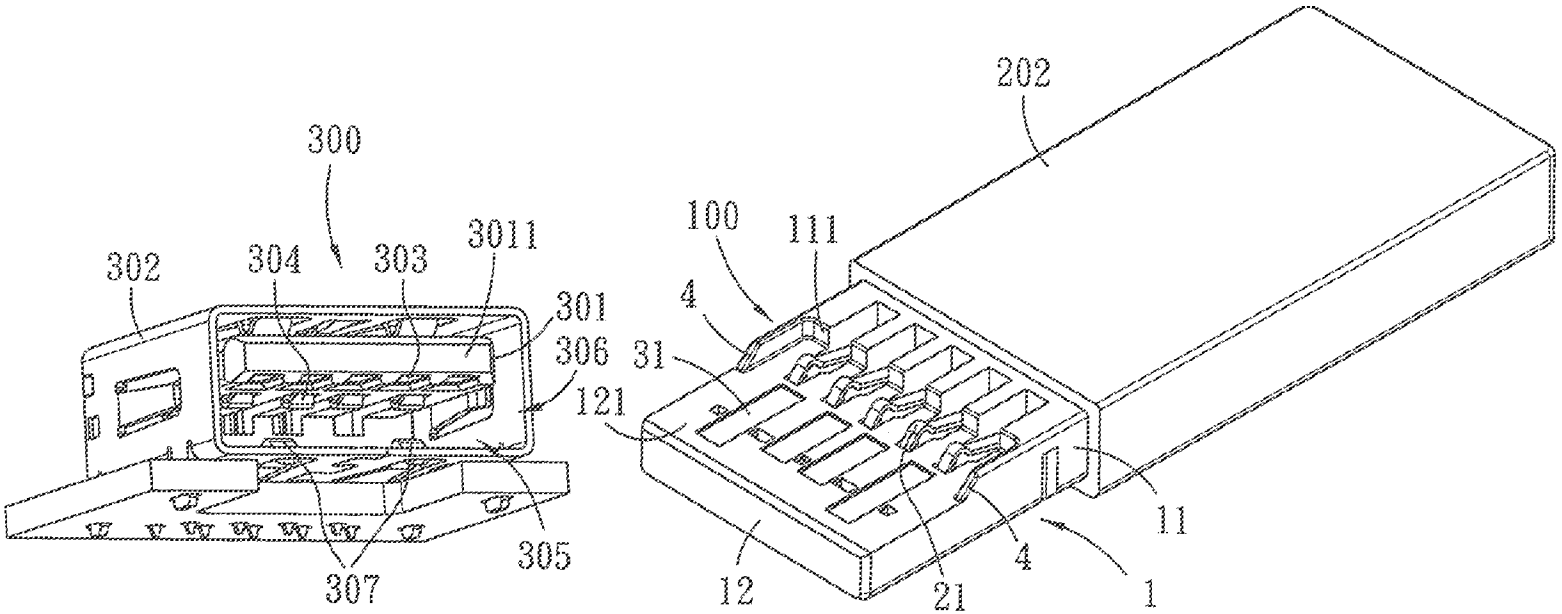
FIG. 3 is a perspective view illustrating a receptacle connector in the first embodiment of the application and an electrical connection device formed by the receptacle connector and the plug connector.
Figure 4:
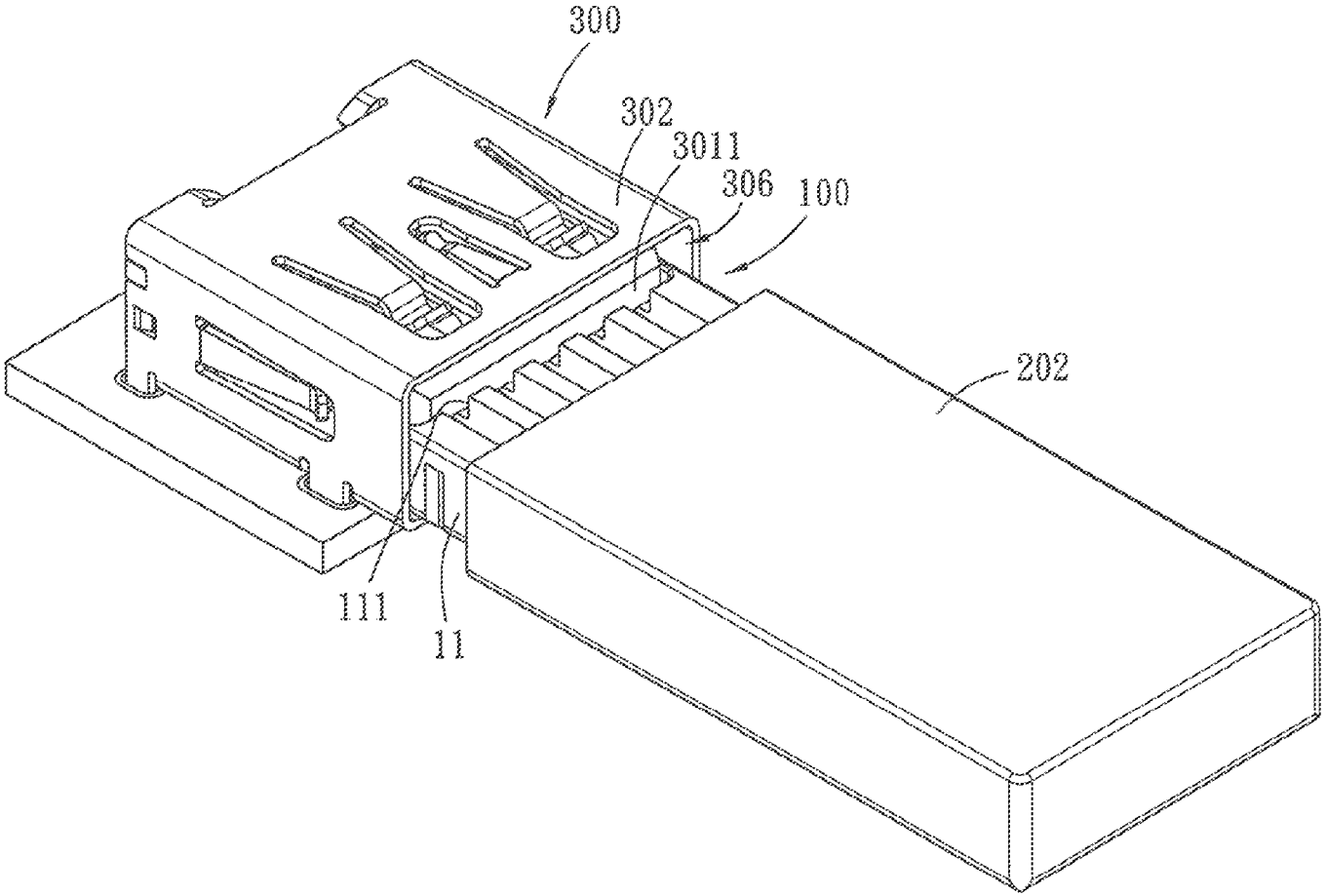
FIG. 4 is a perspective view illustrating a mating state of the receptacle connector and the plug connector in the first embodiments.

Referring to FIGS. 2-4, a first embodiment of a plug connector 100 is described as being provided to an electronic device 200 for example and the plug connector 100 can mate to a receptacle connector 300 to form an electrical connection device.

Figure 5:
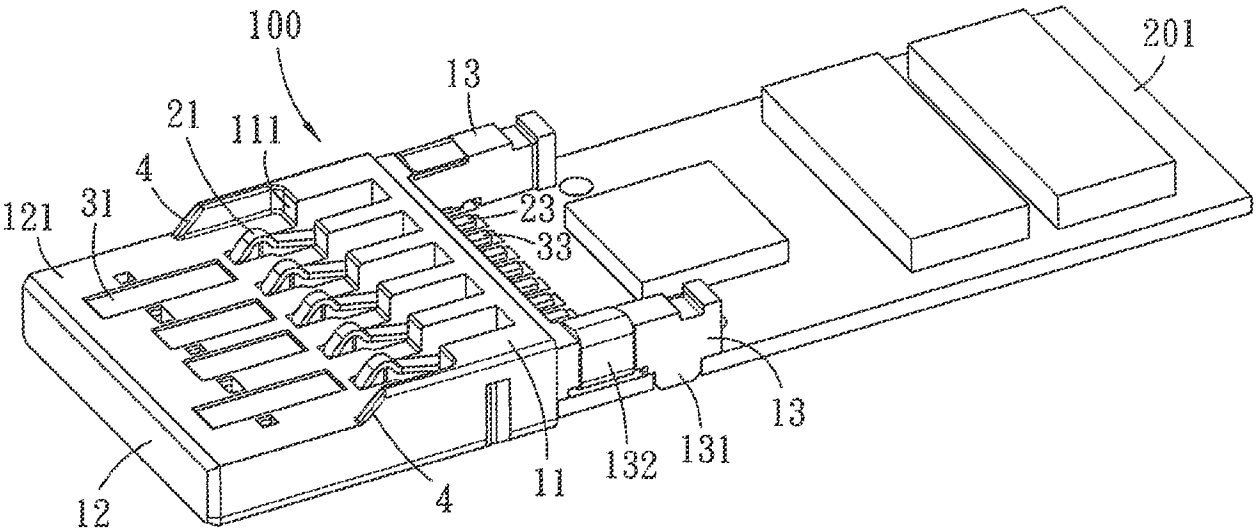
FIG. 5 is a perspective view illustrating a assembling relationship of a circuit board in the electronic device and the plug connector in the first embodiment, in which an outer casing of the electronic device is not shown.
Figure 6:
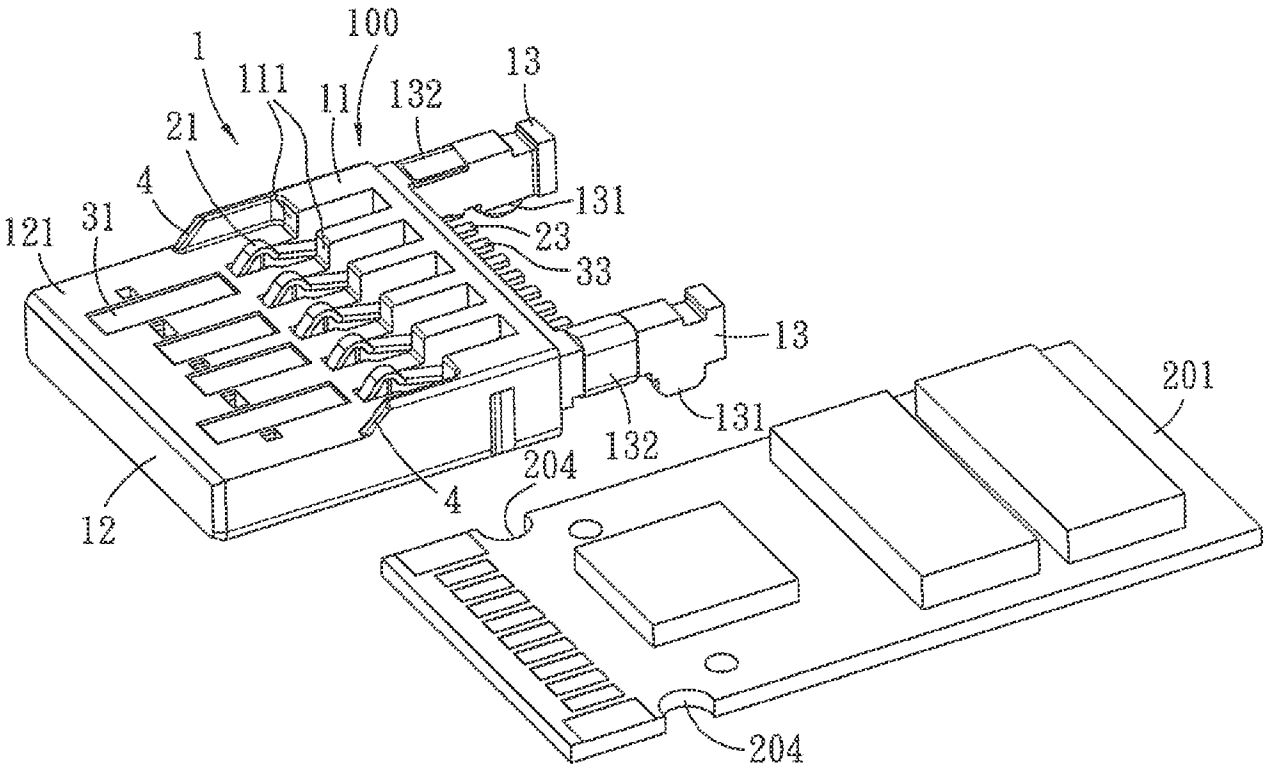
FIG. 6 is an exploded perspective view of FIG. 5.
Figure 7:
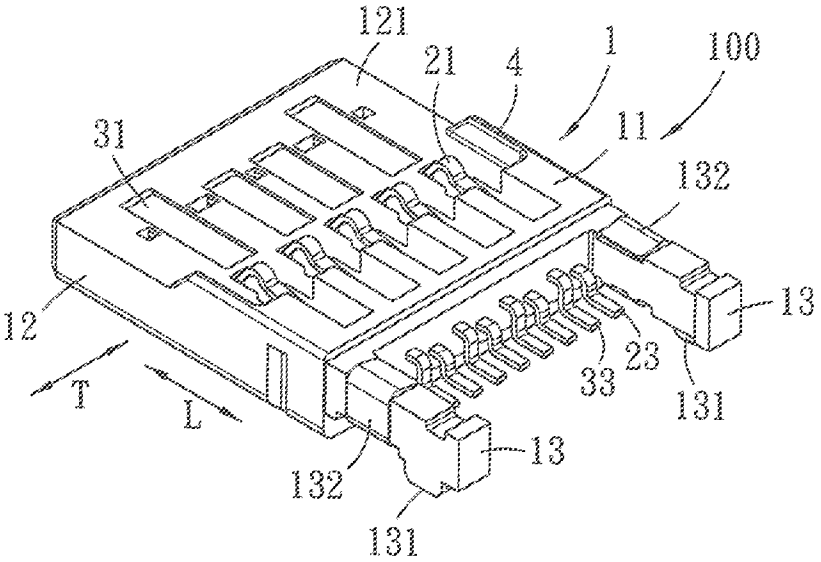
FIG. 7 is a perspective view illustrating the plug connector in the first embodiment.
Figure 8:
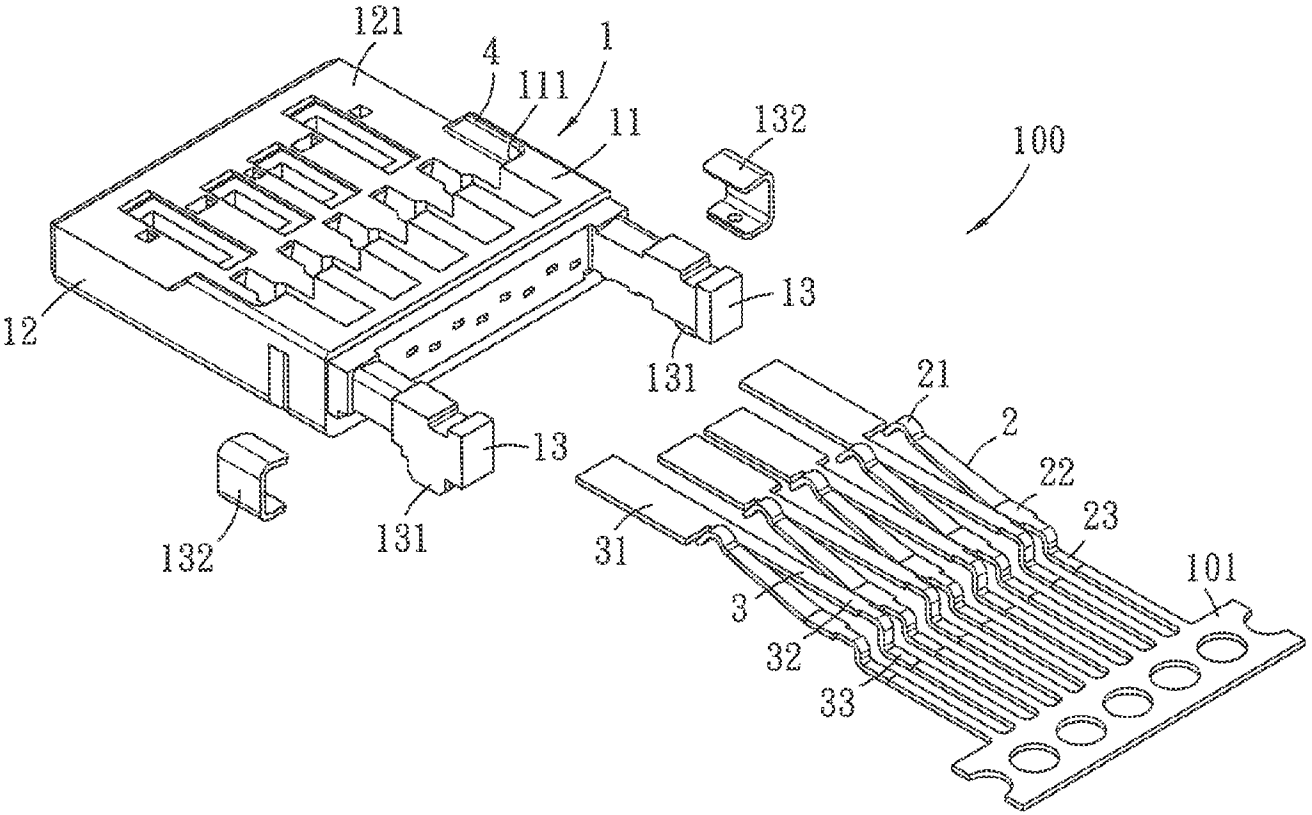
FIG. 8 is a perspective view illustrating an housing, first terminals and second terminals of the plug connector in the first embodiment.
Figure 9:
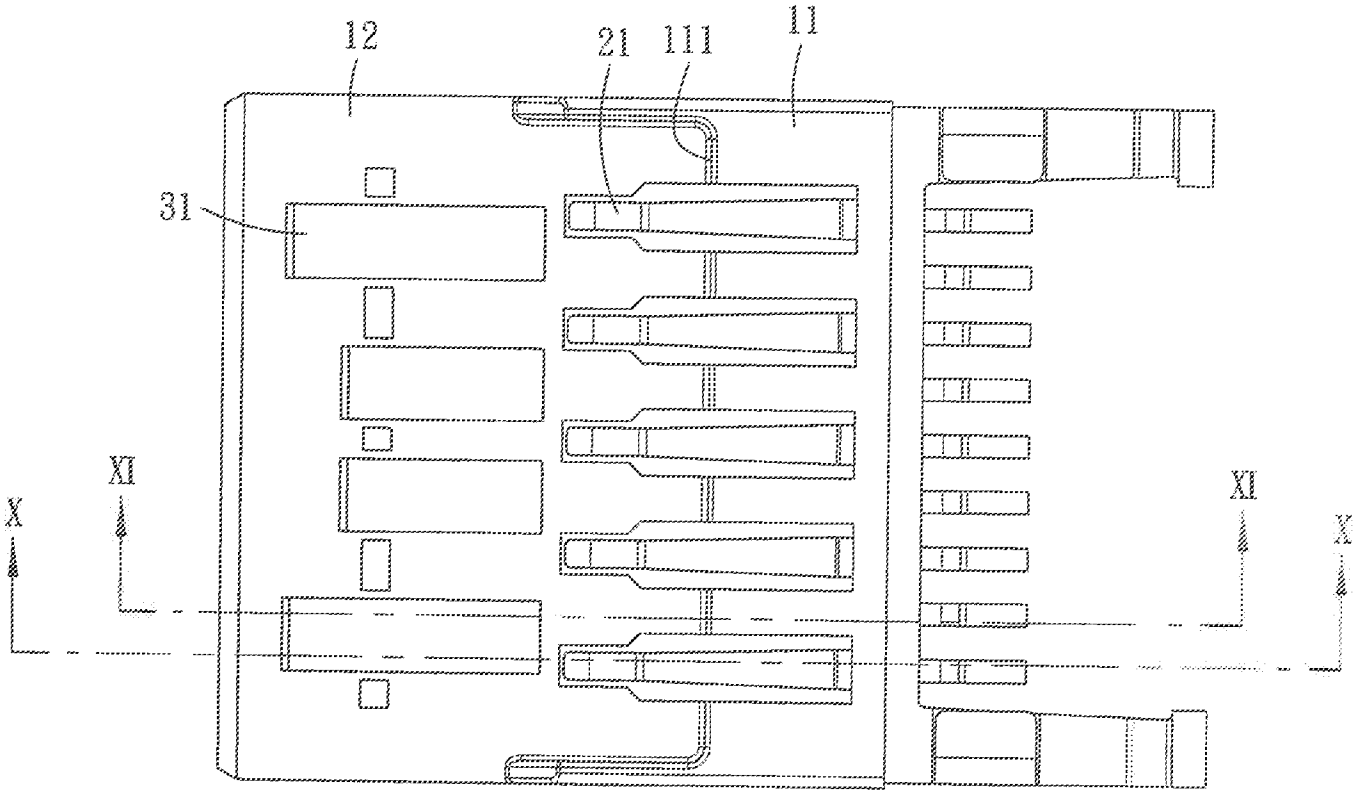
FIG. 9 is a top view of FIG. 7 illustrating the plug connector in the first embodiment.

Referring to FIG. 2, FIG. 5 and FIG. 6, an embodiment of the electronic device 200 comprises the plug connector 100, a circuit board 201, an outer casing 202 and a cap 203. Referring to FIGS. 6-9, the plug connector 100 comprises a housing 1 formed of an insulative material, a plurality of first terminals 2, a plurality of second terminals 3 and a pair of side plates 4. The housing 1 has a base 11, a tongue 12 extending forwardly from the base 11 along a front-rear direction L, and a pair of support arms 13 spaced apart from each other and extending rearwardly from both sides of the base 11, respectively. The base 11 has a mating limit portion 111 which is connected with the tongue 12 and is higher than a plate surface 121 of the tongue 12. The each support arm 13 has a positioning foot 131 and a retained portion 132 formed by a having a side U-shaped metal sheet. In combination with referring to FIG. 5, the circuit board 201 has positioning holes 204 for correspondingly clamping and positioning the positioning feet 131, and the retained portions 132 are fixed to the circuit board 201 by soldering.

Figure 10:
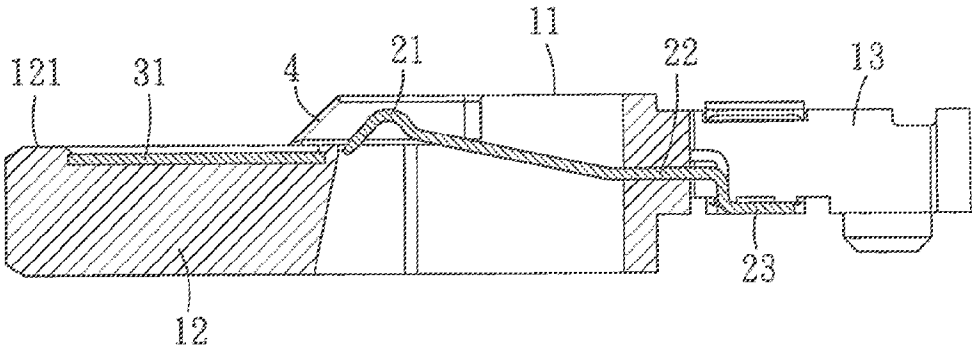
FIG. 10 is a cross-sectional view taken along a line X-X of FIG. 9.
Figure 11:
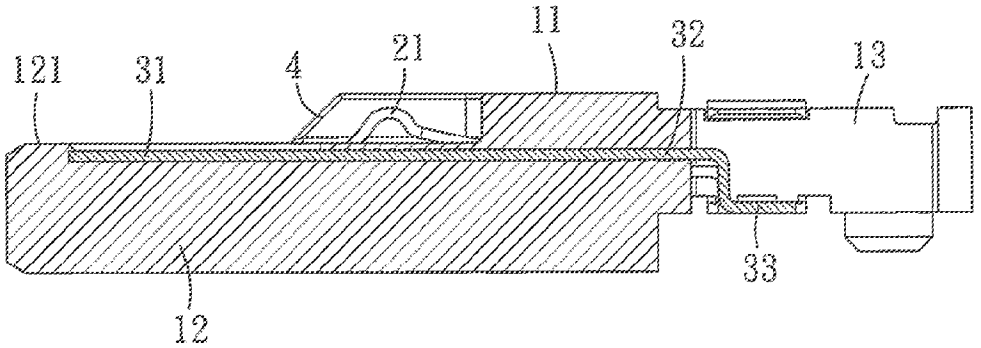
FIG. 11 is a cross-sectional view taken along a line XI-XI of FIG. 9.

Further in combination with referring to FIG. 10 and FIG. 11, the first terminals 2 are mounted to the housing 1, and the each first terminal 2 has a resilient contact portion 21 exposed out from the plate surface 121 of the tongue 12, a first body portion 22 embedded in the housing 1 and a first tail portion 23 extending out from a rear portion of the housing 1, and the first body portion 22 connects the resilient contact portion 21 and the first tail portion 23. The first terminals 2 extend along the front-rear direction L, and the resilient contact portions 21 are arranged as one row in a transverse direction T perpendicular to the front-rear direction L. The second terminals 3 are mounted to the housing 1, and the each second terminal 3 has a flat plate contact portion 31 exposed out from the plate surface 121 of the tongue 12, a second body portion 32 embedded in the housing 1 and a second tail portion 33 extending out from the rear portion of the housing 1, and the second body portion 32 connects the flat plate contact portion 31 and the second tail portion 33. The second terminals 3 also extend along the front-rear direction L, and the flat plate contact portions 31 are arranged as one row along the transverse direction T and positioned in front of the resilient contact portions 21. The first tail portions 23 and the second tail portions 33 are provided alternately and arranged in one row, and are soldered to the circuit board 201 (referring to FIG. 5). In addition, as shown in the embodiment, the first terminals 2 and the second terminals 3 are formed by the same metal sheet, the first tail portions 23 and the second tail portions 33 are arranged in one row and thus together are connected to the same carrier 101, and the second body portions 32 after forming are higher than the first body portions 22 relative to a plane where the plate surface 121 is positioned, so as to make the first body portions 22 and the second body portions 32 offset from each other and not to be in the same plane, and this height difference can allow the first terminals 2 and the second terminals 3 to be spaced from each other and with different front-rear lengths to be formed from the same metal sheet.

In an embodiment, the housing 1 is integrally molded with the first terminals 2 and the second terminals 3 by insert molding. This allows the first tail portions 23 and the second tail portions 33 to be connected together to the same carrier 101. As can be appreciated, the first terminals 2 and the second terminals 3 are positioned together and molded in the insert molding process for forming the housing 1. The carrier 101 can be removed after the housing 1 has been molded. As depicted, the first terminals 2 and the second terminals 3 are together used for transmitting a signal conforming to USB3.0 transmission specification.

Two side plates 4 are positioned face to face at both sides of the tongue 12 respectively parallel to the front-rear direction L. The side plates 4 are higher than the plate surface 121 and have a length of extending along the front-rear direction L such that a height of the side plate 4, which is greater than the plate surface 121, cover a length and a height of the resilient contact portions 21 that are exposed out from the plate surface 121. In other words, the projection of the resilient contact portions 21 that extend out from the tongue 12 are entirely covered by the side plate 4, but the length of the side plate 4 extending forwardly does not cover or only partially covers the flat plate contact portion 31 of the second terminal 3. In short; the length of the two side plates 4 extending along the front-rear direction is more than or equal to a length of front and rear positions of the resilient contact portion 21 exposed out from the plate surface 121. In addition, the height of the two side plates 4 is at least as high as the height of the resilient contact portions 21 and is higher than the plate surface 121, thus the resilient contact portions 21 are positioned between the two side plates 4 so that the resilient contact portions 21 are protected from damaging due to inappropriate external force. In the embodiment, the two side plates 4 and the housing 1 are molded integrally, protrude from both sides of the plate surface 121 of the tongue 12 respectively and rear ends thereof are connected to the mating limit portion 111 of the base 11.

Figure 12:
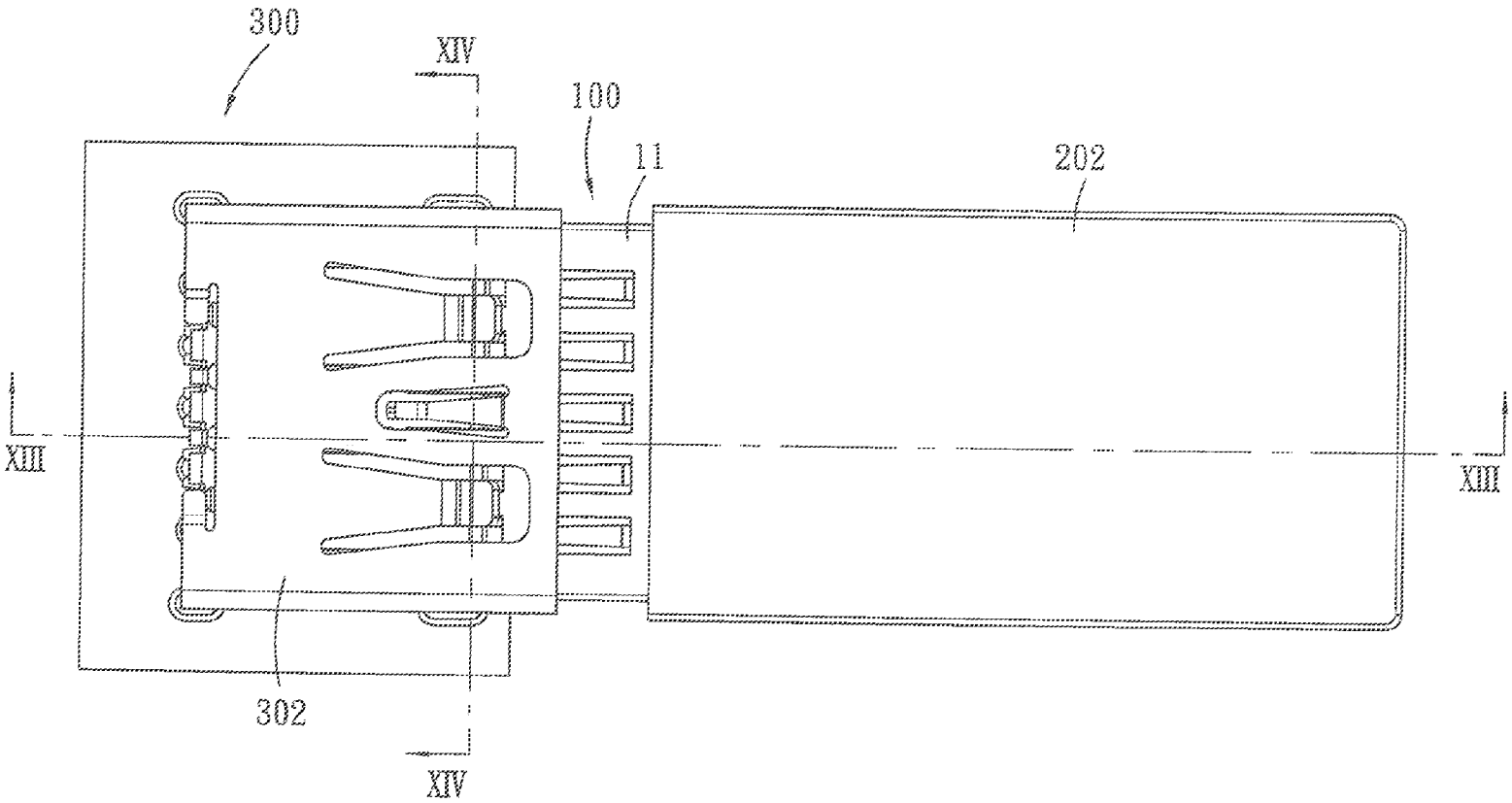
FIG. 12 is a top view of FIG. 4 illustrating a mating state of the receptacle connector and the plug connector in the first embodiment.
Figure 13:
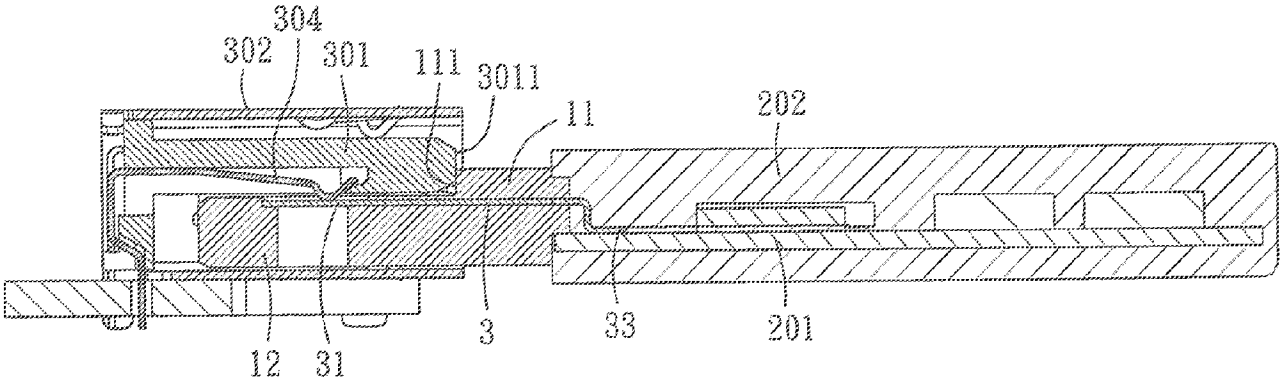
FIG. 13 is a cross-sectional view taken along a line XIII-XIII of FIG. 12.

Referring to FIG. 5, FIG. 12 and FIG. 13, the circuit board 201 is connected to a rear side of the base 11, and the first tail portions 23 and the second tail portions 33 are electrically connected to the circuit board 201. The outer casing 202 surrounds and covers a rear end of the base 11, and extends rearwardly and covers the first tail portions 23, the second tail portions 33, the circuit board 201 and electronic components (not indicated by the reference numeral) on the circuit board 201. Further referring to FIG. 2, the cap 203 can separably cover the plug connector 100 and a latch mechanisms 205 for establishing engagement by protrusion and recess are formed in an inner side face of the cap 203 and both sides of the plug connector 100.

Figure 14:
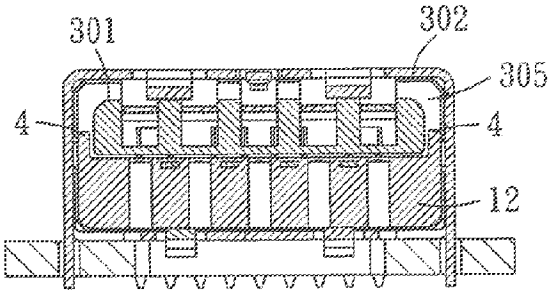
FIG. 14 is a cross-sectional view taken along a line XIV-XIV of FIG. 12.
Figure 16:
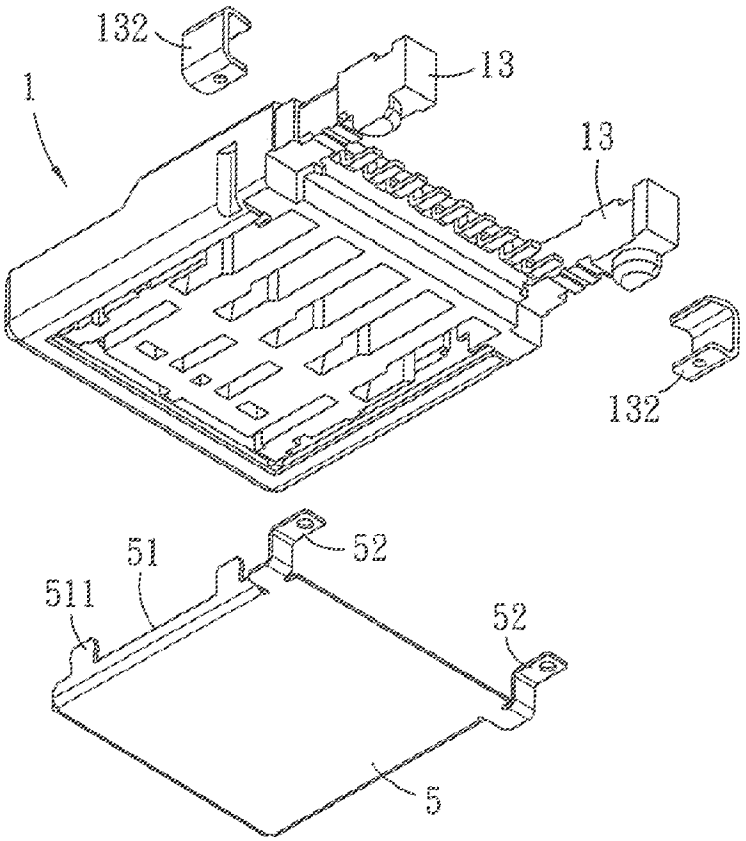
FIG. 16 is an exploded perspective view of FIG. 15.
Figure 15:
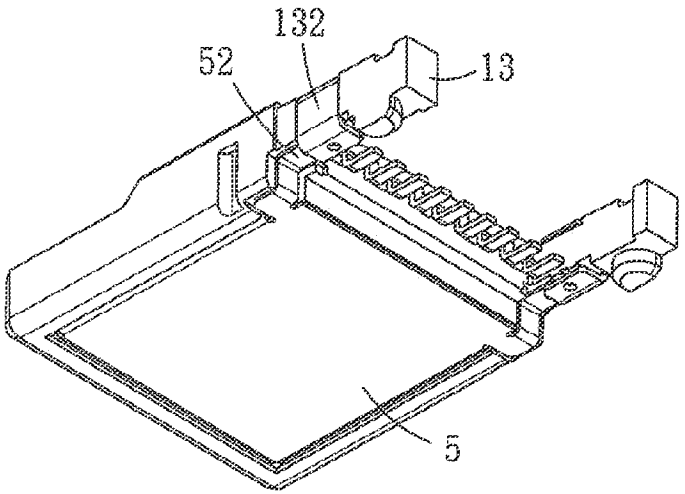
FIG. 15 is a perspective view illustrating a plug connector in a second embodiment of the application.
Figure 17:
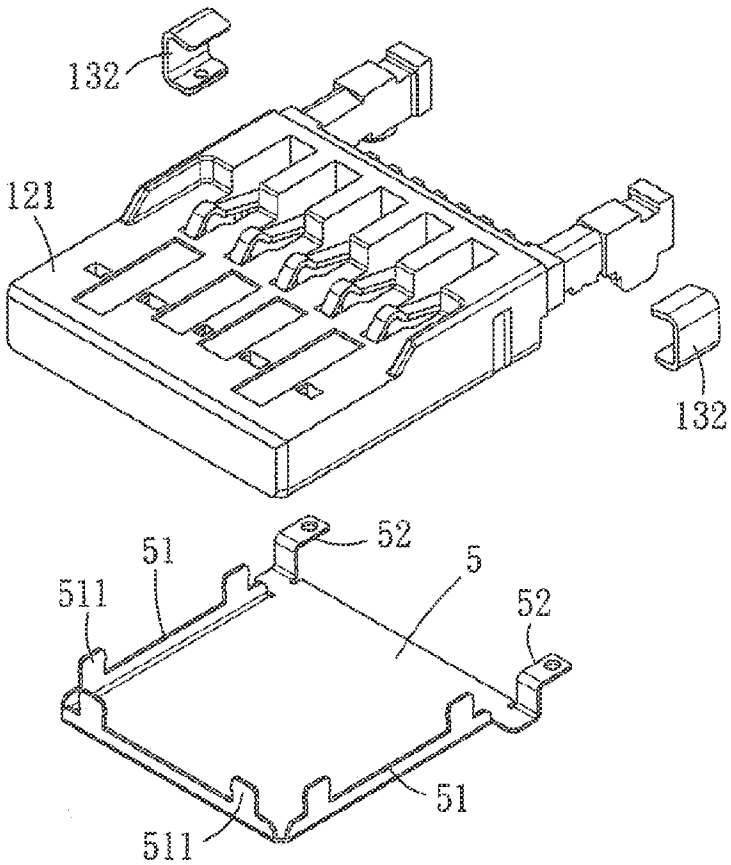
FIG. 17 is a view of FIG. 16 from another angle.
Figure 18:
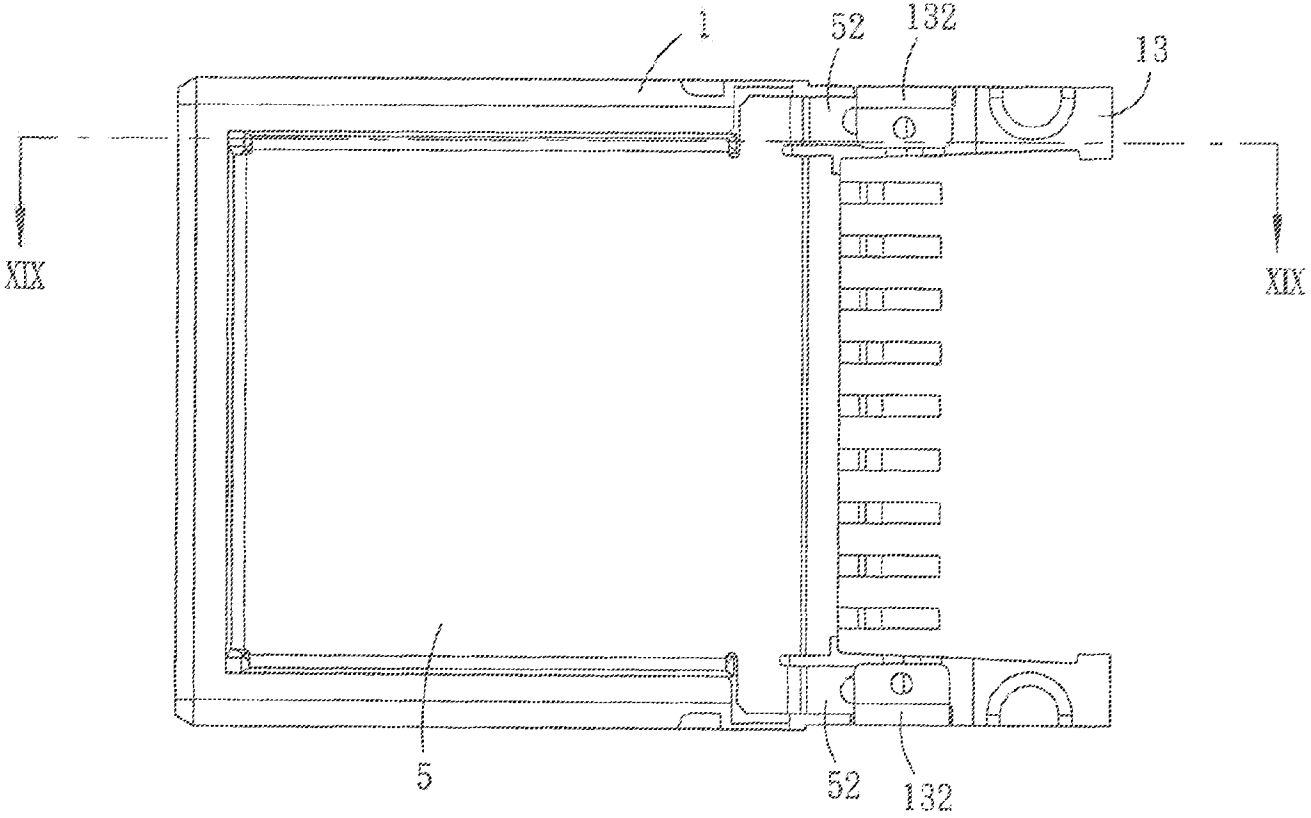
FIG. 18 is a bottom view of FIG. 15.
Figure 19:
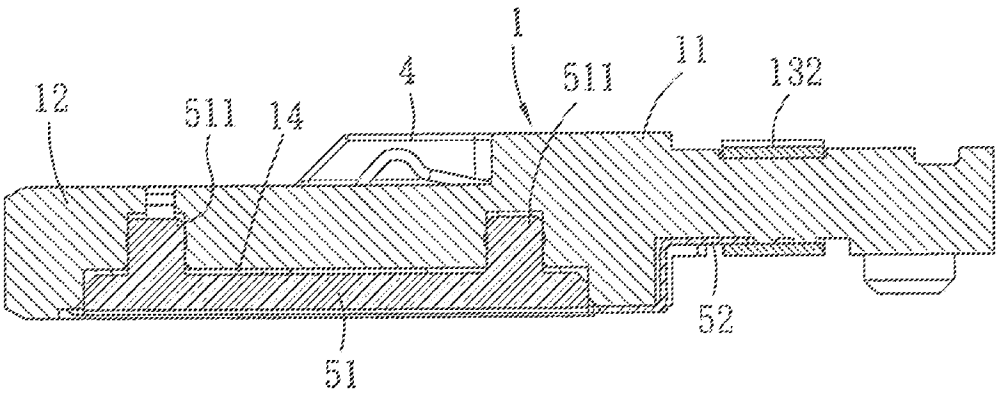
FIG. 19 is a cross-sectional view taken along a line XIX-XIX of FIG. 18.
Figure 20:
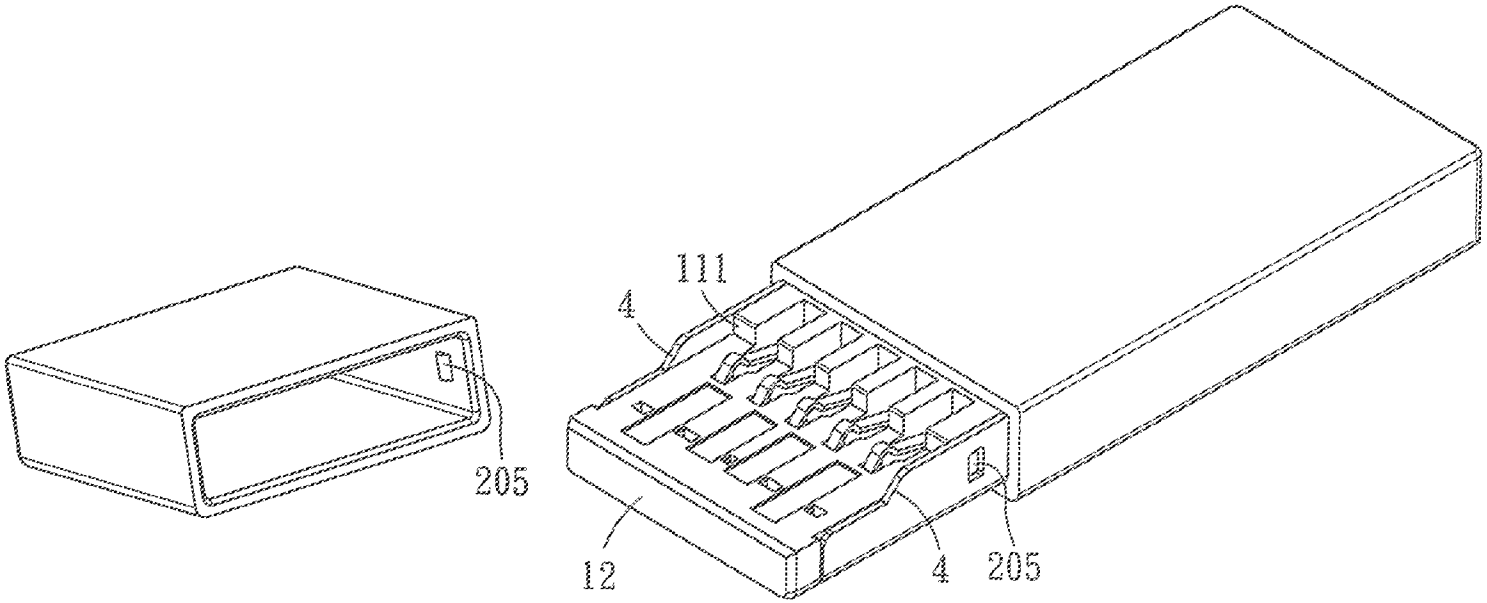
FIG. 20 is a perspective view illustrating an electronic device and receptacle connector in a third embodiment of the application.
Figure 22:
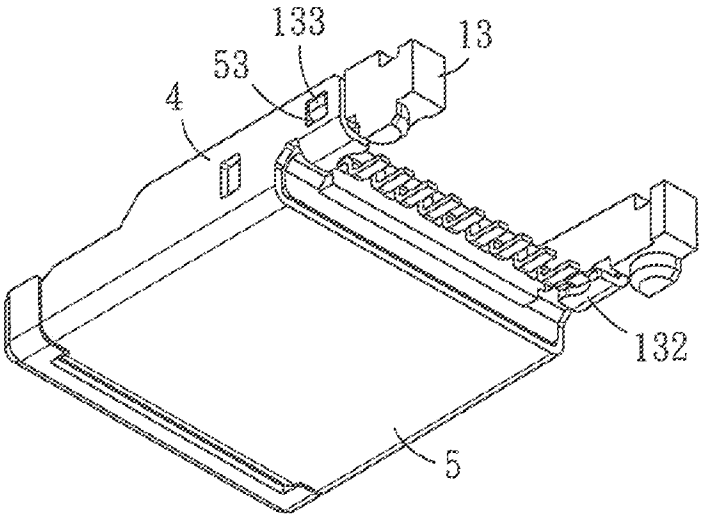
FIG. 22 is a view of FIG. 21 from another angle.
Figure 21:
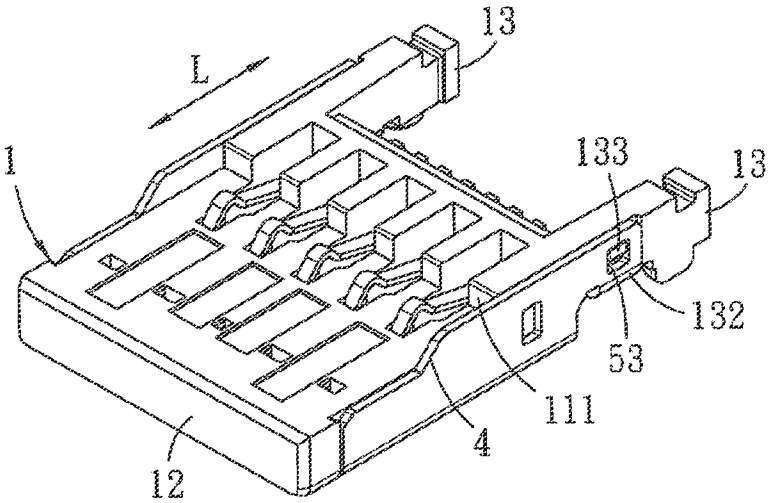
FIG. 21 is a perspective view illustrating a plug connector in the third embodiment.
Figure 23:
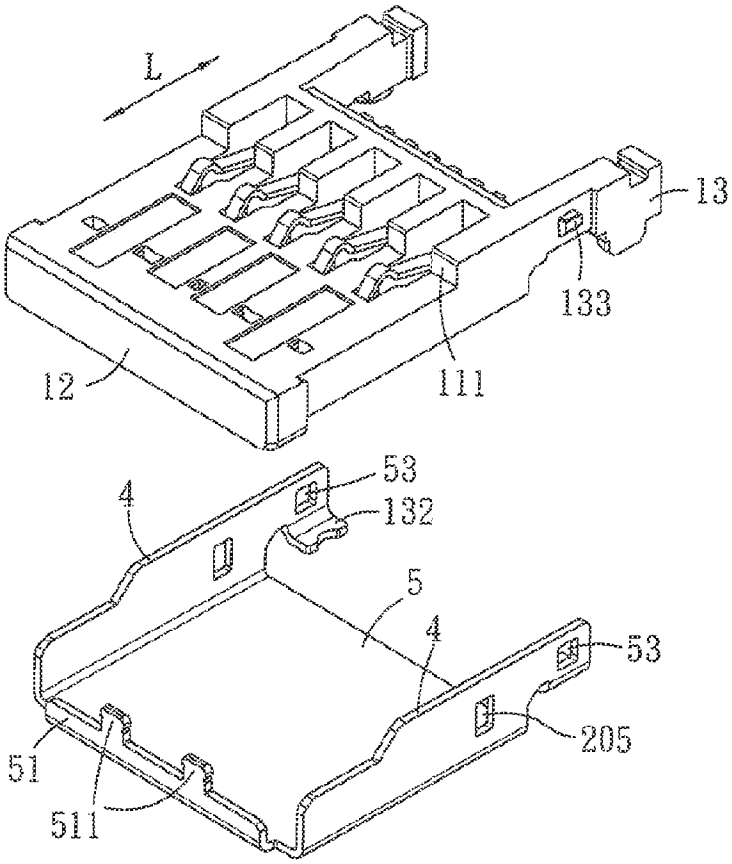
FIG. 23 is an exploded perspective view of FIG. 21.
Figure 24:
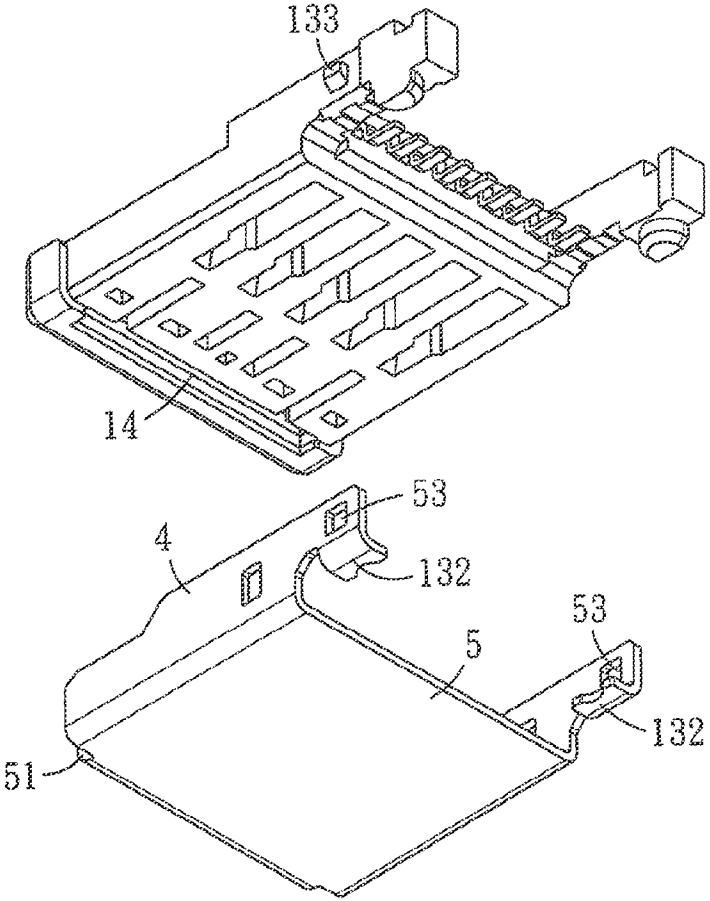
FIG. 24 is a view of FIG. 23 from another angle.

Referring to FIG. 3, the receptacle connector 300 in the embodiment comprises a tongue plate 301, a cage 302 and a plurality of flat plate terminals 303 and a plurality of resilient terminals 304 mounted to the tongue plate 301. The cage 302 surrounds the tongue plate 301 to define a mating space 305 and an insert port 306. The flat plate terminals 303 are arranged as one row and respectively correspond to the resilient contact portions 21 of the first terminals 2 and are closer to the insert port 306 than the resilient terminals 304. The resilient terminals 304 are arranged as one row and respectively correspond to the flat plate contact portions 31 of the second terminals 3. Referring to FIG. 4, FIG. 13 and FIG. 14, when the plug connector 100 and the receptacle connector 300 are mated, the tongue 12 is received in the mating space 305 to mate with a tongue plate 301 and the mating limit portion 111 abuts against an end face 3011 of the tongue plate 301 facing the insert port 306, the two side plates 4 are positioned at both sides of the tongue plate 301, respectively, so as to allow the resilient contact portions 21 of the first terminals 2 to respectively contact the flat plate terminals 303 and allow the flat plate contact portions 31 of the second terminals 3 to respectively contact the resilient terminals 304. As the mating limit portion 111 abuts against the end face 3011 of the tongue plate 301 facing the insert port 306, insertion depth and position of the tongue 12 of the plug connector 100 inserted into receptacle connector 300 are limited so as to ensure the resilient contact portion 21 and the flat plate contact portion 31 of the plug connector 100 reach the correct contact operative position respectively with the flat plate terminal 303 and resilient terminal 304 of the receptacle connector 300. In addition, if the plug connector 100 is inserted into the receptacle connector 300 upside down, a front end of the tongue 12 partially enters into the mating space 305 and the two side plates 4 will abut against a front end of the cage 302 of the receptacle connector 300 so as to prevent incorrect insertion of the plug connector 100.

Referring to FIGS. 15-19, a second embodiment of the plug connector 100 of the application is illustrated. The second embodiment is substantially same as the first embodiment but in the second embodiment the plug connector 100 further comprises a metal plate 5 mounted to one side of the housing 1 opposite to the plate surface 121. The metal plate 5 has a plurality of insert pieces 51 respectively bent and extending from side edges, and a pair of extending pieces 52 respectively corresponding to the support arms 13 and extending, the each insert piece 51 has a plurality of protruded fixed portions 511. The housing 1 further has a plurality of insert slots 14 respectively receiving the insert pieces 51 to allow insertion of the insert pieces 51 and fix the insert pieces 51 by interference between the fixed portions 511 and inner wall faces defining the insert slot 14. The extending pieces 52 respectively contact the metal retained portions 132 and the extending piece 52 is clamped between the retained portion 132 and the support arm 13, so as to increase engagement strength between the metal plate 5 and the housing 1. In addition, the cage 302 of the receptacle connector 300 (referring to FIG. 3) is provided with a plurality of leaf springs 307 at one side facing the tongue plate 301 provided with the flat plate terminals 303 and the resilient terminals 304. Moreover, the metal retained portion 132 is soldered to a grounding wire of the circuit board 201 while contacting the metal plate 5, when the plug connector 100 and the receptacle connector 300 are mated, the metal plate 5 contacts the leaf springs 307 of the cage 302 which is grounded, so as to function as electromagnetic shielding protection.

Referring to FIGS. 20-24, a third embodiment of the plug connector 100 of the application is illustrated. The third embodiment is substantially similar to the first embodiment, but in the third embodiment the plug connector 100 further comprises a metal plate 5 mounted to one side of the housing 1 opposite to the plate surface 121. And, the two side plates 4 integrally extend from both sides of the metal plate 5, respectively, and are positioned at both sides of the tongue 12 and the mating limit portion 111 parallel to the front-rear direction L. Moreover, the retained portions 132 of the support arms 13 are also formed respectively by metal pieces with bending and integrally extending the metal plate 5. In other words, the metal plate 5, the side plates 4 and the metal pieces forming the retained portions 132 on the support arms 13 are integrally formed from the same material. In addition, the metal plate 5 has an insert piece 51 bent and extending from a front side, and the insert piece 51 has two protruded fixed portions 511. The housing 1 further has an insert slot 14 correspondingly receiving the insert piece 51 to allow insertion of the insert piece 51 and fix the insert piece 51 by interference between the fixed portions 511 and inner wall faces defining the insert slot 14. For matching the two side plates 4 integrally extending from the metal plate 5, in the embodiment, both sides of the housing 1 parallel to the front-rear direction L are respectively recessed inwardly partially, a thickness at each side that is moved inwardly is roughly equal to a thickness of the metal plate, to make a space for provision of the two side plates 4, so as to allow an overall width of the plug connector 100 in the second embodiment to be equal to that of the first embodiment. In addition, the each support arm 13 is provided with a clamping block 133 to engage with the corresponding through hole 53 provided to the metal piece forming the retained portion 132. Similarly to the second embodiment, when the plug connector 100 and the receptacle connector 300 (referring to FIG. 3) are mated, the metal plate 5 contacts the leaf springs 307. The metal plate 5 can function as electromagnetic shielding protection.

As can be appreciated, the plug connector 100 of the application is a low profile plug that has the resilient contact portion 21 and the flat plate contact portion 31. The plug connector 100 has the mating limit portion 111 that abuts against the end face 3011 of the tongue plate 301 facing the insert port 306 such that aninsertion depth and position of the tongue 12 of the plug connector 100 inserted into receptacle connector 300 are limited. This helps ensure the resilient contact portion 21 and the flat plate contact portion 31 of the plug connector 100 reach the correct contact operative position respectively with the flat plate terminal 303 and the resilient terminal 304 of the receptacle connector 300. And both sides of the resilient contact portions 21 can be protected from damage due to inappropriate external force by the two side plates 4. The metal plate 5 can also provide electromagnetic shielding protection.

However, what have been described above are only embodiments of the application, the implementation scope of the application is not limited to that, that is, simple equivalent variations and modifications which are made according to the Claims and the description content of the application are included in the protective scope of the application.

What is claimed is:

1. A plug connector, comprising:

a housing having a base and a tongue with a plate surface, the tongue extending forwardly from the base along a first direction, the base having a mating limit portion connected to the tongue and extending above the plate surface;

a plurality of first terminals mounted to the housing, each of the first terminal having a resilient contact portion exposed and extending out of the plate surface of the tongue, the resilient contact portions being arranged as one row, wherein the first plurality of terminals each have a tail and the tails of the first plurality of terminals are in a tail row;

a plurality of second terminals mounted to the housing, each of the second terminals having a flat plate contact portion exposed out from the plate surface of the tongue, the flat plate contact portions being arranged in one row and positioned in front of the resilient contact portions, wherein the plurality of second terminals each have a tail and the tails of the plurality of second terminals are in the tail row so that the tails of the first plurality of terminals and the tails of the second plurality of terminals are each configured to be soldered to a first side of a first circuit board along the tail row; and a pair of side plates positioned respectively positioned along both sides of the tongue, wherein a length of the two side plates extends above the plate surface in a for-aft direction so as to extend along and protect the resilient contact portions which are exposed out from the plate surface, wherein the resilient contact portions are position between the two side plates.

2. The plug connector according to claim 1, wherein the two side plates and the housing are molded integrally and protrude from both sides of the plate surface of the tongue respectively and rear ends of the two side plates are connected to the mating limit portion.

3. The plug connector according to claim 2, further comprising a metal plate mounted to one side of the housing opposite the plate surface.

4. The plug connector according to claim 1, further comprising a metal plate mounted to one side of the housing opposite to the plate surface, the two side plates integrally extending from both sides of the metal plate respectively and being positioned at both sides of the tongue and the mating limit portion.

5. A plug connector, comprising:

a housing having a base and a tongue with a plate surface, the tongue extending forwardly from the base along a first direction, the base having a mating limit portion connected to the tongue and extending above the plate surface;

a plurality of first terminals mounted to the housing, each of the first terminal having a resilient contact portion exposed and extending out of the plate surface of the tongue, the resilient contact portions being arranged as one row;

a plurality of second terminals mounted to the housing, each of the second terminals having a flat plate contact portion exposed out from the plate surface of the tongue, the flat plate contact portions being arranged in one row and positioned in front of the resilient contact portions; and a pair of side plates positioned respectively positioned along both sides of the tongue, wherein a length of the two side plates extends above the plate surface in a for-aft direction so as to extend along and protect the resilient contact portions which are exposed out from the plate surface, wherein the resilient contact portions are position between the two side plates, the plug connector further comprising a metal plate mounted to one side of the housing opposite to the plate surface, the two side plates integrally extending from both sides of the metal plate respectively and being positioned at both sides of the tongue and the mating limit, wherein the lengths of the two side plates extending forwardly do not cover or only partially cover the flat plate contact portions of the second terminals.

6. A plug connector, comprising:

an housing having a base and a tongue with a plate surface, the tongue extending forwardly from the base along a first direction, the base having a mating limit portion connected to the tongue and extending above the plate surface;

a plurality of first terminals mounted to the housing, each of the first terminal having a resilient contact portion exposed and extending out of the plate surface of the tongue, the resilient contact portions being arranged as one row;

a plurality of second terminals mounted to the housing, each of the second terminals having a flat plate contact portion exposed out from the plate surface of the tongue, the flat plate contact portions being arranged in one row and positioned in front of the resilient contact portions; and a pair of side plates positioned respectively positioned along both sides of the tongue, wherein a length of the two side plates extends above the plate surface in a for-aft direction so as to extend along and protect the resilient contact portions which are exposed out from the plate surface, wherein the resilient contact portions are position between the two side plates, wherein each first terminal further has a first body portion embedded in the housing and a first tail portion extending out from a rear portion of the housing, the first body portion connecting the resilient contact portion and the first tail portion, and each second terminal has a second body portion embedded in the housing and a second tail portion extending out from the rear portion of the housing, and the second body portion connects the flat plate contact portion and the second tail portion, and the first tail portions and the second tail portions are provided alternately and arranged in one row, wherein the second body portions are position higher than the first body portions relative to the plate surface.

7. The plug connector according to claim 1, wherein the housing includes a pair of support arms spaced apart from each other and extending rearwardly from both sides of the base.

8. A plug connector, comprising:

an housing having a base and a tongue with a plate surface, the tongue extending forwardly from the base along a first direction, the base having a mating limit portion connected to the tongue and extending above the plate surface;

a plurality of first terminals mounted to the housing, each of the first terminal having a resilient contact portion exposed and extending out of the plate surface of the tongue, the resilient contact portions being arranged as one row;

a plurality of second terminals mounted to the housing, each of the second terminals having a flat plate contact portion exposed out from the plate surface of the tongue, the flat plate contact portions being arranged in one row and positioned in front of the resilient contact portions; and a pair of side plates positioned respectively positioned along both sides of the tongue, wherein a length of the two side plates extends above the plate surface in a for-aft direction so as to extend along and protect the resilient contact portions which are exposed out from the plate surface, wherein the resilient contact portions are position between the two side plates, wherein the housing includes a pair of support arms spaced apart from each other and extending rearwardly from both sides of the base and wherein the each support arm has a positioning foot and a metal retained portion.

9. The plug connector according to claim 8, further comprising a metal plate mounted to one side of the housing opposite to the plate surface, the two side plates extending respectively from opposite sides of the metal plate and being positioned at both sides of the tongue and the mating limit portion, the retained portions of the support arms integrally formed and extending from the metal plate.

10. The plug connector according to claim 8, further comprising a metal plate mounted to one side of the housing opposite to the plate surface, the metal plate having a pair of extending pieces respectively correspondingly contacting the metal retained portions.

11. An electrical connection device comprising a plug connector and a receptacle connector which can mate to form electrical connection;

the plug connector, comprising:

a housing having a base and a tongue extending forwardly from the base along a front-rear direction, the base having a mating limit portion connecting the tongue and higher than a plate surface of the tongue;

a plurality of first terminals mounted to the housing, and the each first terminal having a resilient contact portion exposed out from the plate surface of the tongue, the resilient contact portions being arranged as one row;

a plurality of second terminals mounted to the housing, and the each second terminal having a flat plate contact portion exposed out from the plate surface of the tongue, the flat plate contact portions being arranged as one row and positioned in front of the resilient contact portions; and a pair of side plates positioned face to face at both sides of the tongue respectively, lengths of the two side plates extending along the front-rear direction and heights of the two side plates higher than the plate surface covering lengths and heights of the resilient contact portions which are exposed out from the plate surface, so as to allow the resilient contact portions to position between the two side plates;

the receptacle connector comprising a tongue plate, a cage and a plurality of flat plate terminals and a plurality of resilient terminals mounted to the tongue plate, the cage surrounding the tongue plate to define a mating space and an insert port, the flat plate terminals being arranged as one row and respectively corresponding to the resilient contact portions of the first terminals and being closer to the insert port than the resilient terminals, the resilient terminals being arranged as one row and respectively corresponding to the flat plate contact portions of the second terminals;

when the plug connector and the receptacle connector are mated, the tongue being received in the mating space to mate the tongue plate and the mating limit portion abutting against an end face of the tongue plate facing the insert port, so as to allow the resilient contact portions of the first terminals to respectively contact the flat plate terminals and allow the flat plate contact portions of the second terminals to respectively contact the resilient terminals.

12. The electrical connection device according to claim 11, wherein when the plug connector and the receptacle connector are mated, the two side plates are positioned at both sides of the tongue plate respectively.

13. The electrical connection device according to claim 12, wherein the two side plates and the housing are molded integrally, protrude from both sides of the plate surface of the tongue respectively and rear ends of the two side plates are connected to the mating limit portion.

14. The electrical connection device according to claim 13, wherein the plug connector further comprises a metal plate mounted to one side of the housing opposite to the plate surface, the cage of the receptacle connector has a plurality of leaf springs, when the plug connector and the receptacle connector are mated, the metal plate contacts the leaf springs.

15. The electrical connection device according to claim 14, wherein the plug connector further comprises a metal plate mounted to one side of the housing opposite to the plate surface, the two side plates integrally extend from both sides of the metal plate respectively, and are positioned at both sides of the tongue and the mating limit portion, the cage of the receptacle connector has a plurality of leaf springs, when the plug connector and the receptacle connector are mated, the metal plate contacts the leaf springs.

16. The electrical connection device according to claim 12, wherein the housing further has a pair of support arms spaced apart from each other and extending rearwardly from both sides of the base respectively.

17. An electronic device, comprising:

a plug connector, comprising:

a housing having a base and a tongue extending forwardly from the base along a front-rear direction, the base having a mating limit portion connecting the tongue and higher than a plate surface of the tongue;

a plurality of first terminals mounted to the housing, and the each first terminal having a resilient contact portion exposed out from the plate surface of the tongue, the resilient contact portions being arranged as one row;

a plurality of second terminals mounted to the housing, and the each second terminal having a flat plate contact portion exposed out from the plate surface of the tongue, the flat plate contact portions being arranged as one row and positioned in front of the resilient contact portions; and a pair of side plates positioned face to face at both sides of the tongue respectively, lengths of the two side plates extending along the front-rear direction and heights of the two side plates higher than the plate surface covering lengths and heights of the resilient contact portions which are exposed out from the plate surface, so as to allow the resilient contact portions to position between the two side plates;

a circuit board connected to a rear side of the base, and the first tail portions and second tail portions being electrically connected to the circuit board; and an outer casing surrounding and covering a rear end of the base, and extending rearwardly and covering the first tail portions, the second tail portions and the circuit board, wherein the housing further has a pair of support arms spaced apart from each other and extending rearwardly from both sides of the base, the support arms abuts against the circuit board respectively, wherein the each support arm has a positioning foot and a metal retained portion, the circuit board has positioning holes for respectively clamping and positioning the positioning feet, the retained portions are fixed to the circuit board by soldering.

18. The electronic device according to claim 17, wherein the plug connector further comprises a metal plate mounted to one side of the housing opposite to the plate surface, the two side plates integrally extend from both sides of the metal plate respectively, and are positioned at both sides of the tongue and the mating limit portion respectively, the retained portions of the support arms being integrally formed and extending from the metal plate.

* * * * *